United States Patent [19]

Smith

[11] 4,421,500

[45] Dec. 20, 1983

[54] MANUALLY OPERABLE FOLDING GUIDE

[76] Inventor: Samuel C. Smith, 210 Hartman Rd., Newton Centre, Mass. 02159

[21] Appl. No.: 395,280

[22] Filed: Jul. 6, 1982

[51] Int. Cl.[3] ..... B65H 45/00

[52] U.S. Cl. ..... 493/405

[58] Field of Search ..... 493/405, 408, 451–458, 493/460; 33/174 TA, 176

[56] References Cited

U.S. PATENT DOCUMENTS

| | | | |
|---|---|---|---|
| 514,013 | 2/1894 | Litchfield | 493/405 |
| 702,085 | 6/1902 | Barnes | 493/405 |
| 747,085 | 12/1903 | Rieffel | 493/405 |
| 797,864 | 8/1905 | Naylor | 493/405 |
| 3,717,366 | 2/1973 | Decker | 493/457 X |

*Primary Examiner*—A. J. Heinz

*Attorney, Agent, or Firm*—Donald W. Meeker

[57] ABSTRACT

There is disclosed in the present application a folding guide including a middle panel and two outer hinged flaps designed in such a way that when the outer flaps are alternately folded and retracted, a sheet of paper nested on the folder, is folded and ready to put in an envelope.

9 Claims, 5 Drawing Figures

MANUALLY OPERABLE FOLDING GUIDE

The present invention relates generally to paper folding guides for such articles as letter size sheets but more particularly to such guides which are readily portable and require only manual operation.

There are many situations where a number of mailings have to be sent out. The number, however, does not warrant expenditure of a costly equipment; therefore, the conventional method of having to gage the fold of each of numerous letters prior to placing in the envelope is resorted to. This is both time consuming and costly. The alternative is to be satisfied with lack of accuracy and uniformity in the placement of a fold which makes a poor impression upon the recipient.

It is accordingly an object of the present invention to ease the task of folding letters or messages without requiring costly equipment.

A more general object is to improve both the efficiency and uniformity of folding letters or mailing materials.

The foregoing objects are achieved in accordance with a feature of the present invention by a folding guide or assembly including a relatively rigid panel removably fixable to a table top and to one edge of which is pivoted a flap for forming a single fold.

According to another feature, a second opposed flap is added for properly folding a sheet of paper uniformly in two places preparatory to stuffing in an envelope. An added feature relates to the use of an adjustable stop on one of the flaps for positioning paper sheets either for forming a single fold or for locating paper sheets which are shorter than the capacity of the assembly.

The foregoing objects and features will be more clearly understood from the following detailed description of an illustrative embodiment of the invention taken in connection with the accompanying drawings in which.

Figure 1:
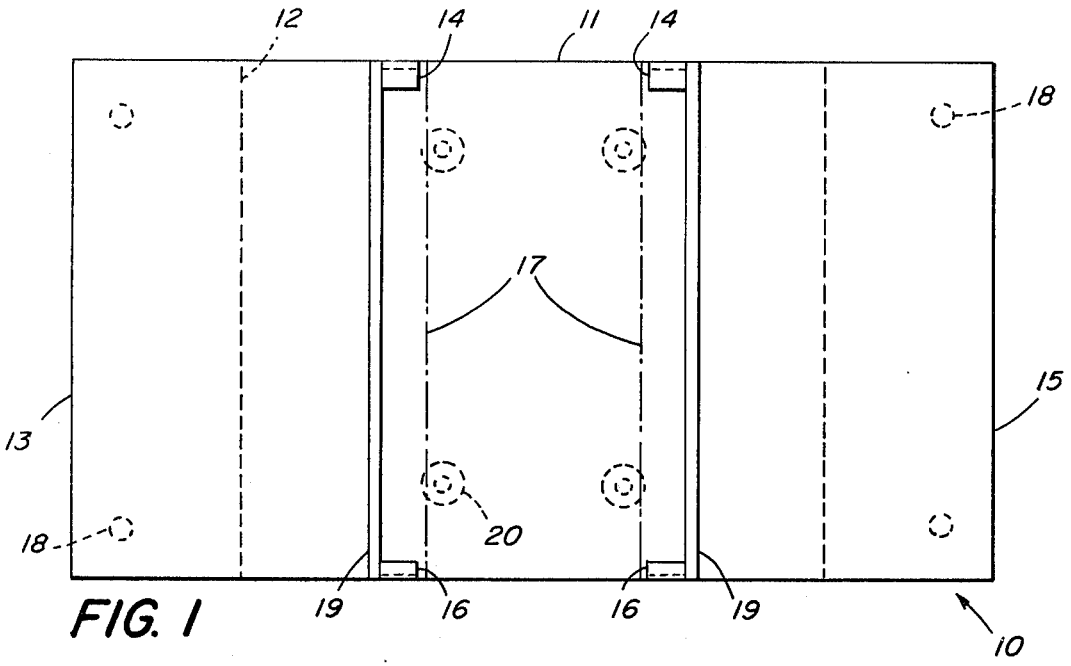
FIG. 1 is a plan view of a folding assembly according to the invention.
Figure 2:
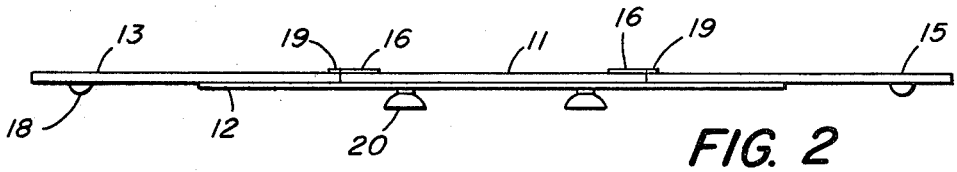
FIG. 2 is a view in front elevation of the folder depicted in FIG. 1.
Figure 3:
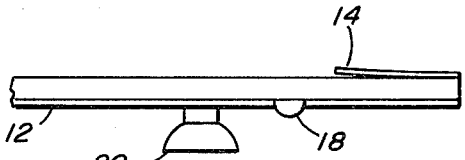
FIG. 3 is a fragmentary view in right side elevation, on an enlarged scale depicting a retainer forming a part of the folder of FIGS. 1 and 2.
Figure 4:
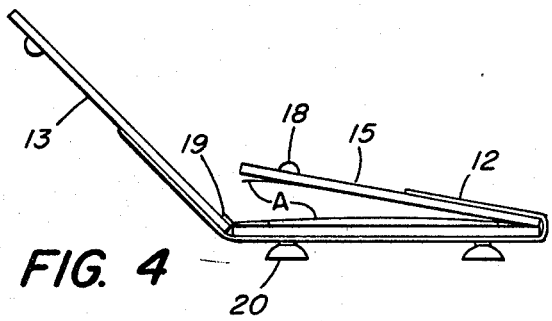
FIG. 4 is a view in front elevation of a folder shown in the previous figures, being used in the process of folding a sheet.

Turning now to the drawings, particularly FIGS. 1 and 2, there is shown a three-section folder according to the present invention and indicated generally at 10. The folder 10, having an overall length somewhat greater than that of a work-piece to be folded, includes a central panel 11 to which are hingedly connected by a flexible elastic sheet 12, a pair of flaps 13 and 15. For locating a sheet of paper in the folder, preparatory to a folding operation, there are provided upper and lower pairs of guides or retainers 14 and 16 respectively. The upper guides 14 are deeply undercut to receive a paper sheet with one of its long edges slid upwardly beneath the overhang to the stop (dashed lines), the paper sheet then being slid downwardly to have its lower edge located beneath the more shallowly undercut lower guides 16. The elastic sheet 12 is fixedly secured, as by cementing, to the backs of the flaps 13 and 15 and of the central panel 11 leaving an unsecured margin about ¾" from each edge of the central panel, as shown by the dash and dot lines 17 of the panel 11. Elastic sheet 12 thereby provides both a hinge and a spring action to self-retract the flaps.

Pairs of spacers 18 are affixed to the bottom of the flaps 13 and 15 to permit the operator's hands to be introduced easily beneath the flaps. In addition, a creasing strip 19 is fixedly secured, as by cementing, to the margin of each flap nearest the hinge at the panel. As the flap is pivoted, because of the form of the hinge provided to the sheet, the outer edge of the strip 19 imparts a crease-forming, squeezing and sweeping motion to the work-piece.

Figure 5:
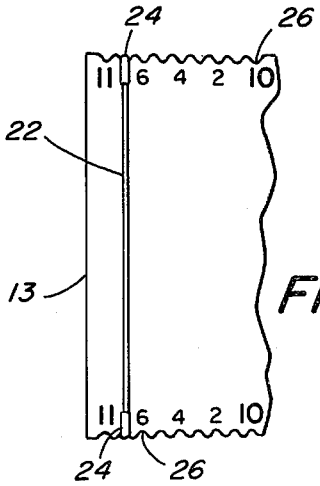
FIG. 5 is a fragmentary view showing an alternative form of folder including an adjustable end stop for the sheet which is to be folded.

In FIG. 5, there is shown an adjustable locator device for an end of the work-piece A, including a resilient band 22 stretched between stop members 24 each formed with an integral hook to engage similarly numbered notches 26 in the edges of the flap 13. In positioning a short sheet for two folds or for a single fold, the top or bottom of the sheet is inserted into the folder to abut the members 24 for accurate and uniform positioning. Whole and fractional numbers are used in numbering the notches. The equally-spaced numbers for the corresponding notches are double-counted; therefore, placing the left end of the work-piece A at the number corresponding to its length is all that is necessary to achieve the desired fold. The fractional numbers being small as compared to the whole numbers and represent, as shown in FIG. 5, one-eighth encrements. The type of fold desired—double or single—can be obtained by using either (for single fold) or both (for double fold) flaps. In general, the following process in double folding takes place by first folding and releasing the left flap 13 and then the right one 15. Note that proper operation will cause the right hand flap 15 to terminate its folding travel even before the left hand flap has completed its retraction. An experiment using a prototype with 40 mil thick silicon rubber for elastic sheet 12, indicated a rate of 20 to 30 foldings (double folding) per minute.

From the above description of an illustrative embodiment, taken in connection with the accompanying drawings, many variations within the scope of the invention will become apparent to those of ordinary skill in the art. It is therefore not intended that the specification and drawings be taken in a limiting sense but rather that the scope of the invention be interpreted in terms of the appended claims.

Having thus disclosed my invention, what I claim as new and desire to secure by Letters Patent of the United States is:

1. A folder assembly for an elongated work-piece comprising a relatively flat and rigid panel provided with at least one straight edge and at least one self-retractable flap provided with a matching straight edge located along the straight edge of the panel and elastic means hingedly connecting the flap to the panel across the matching straight edges, including an elastic sheet material secured to a back surface of the flap and panel wherein the work-piece is folded along the matching straight edges and the elastic sheet provides both a hinge and a spring action.

2. A folder assembly according to claim 1 wherein a first self-retractable flap nearly equals the panel area and further comprising a second similar self-retractable flap hingedly connected by an elastic means along an opposite parallel straight edge of the panel wherein the flaps are each folded and self-retracted alternately one flap at a time over the central panel.

3. A folder assembly according to claim 2 further comprising suction means in a bottom surface of the panel for releasably securing the folder assembly to a supporting table top to prevent sliding of the folder assembly and spacer means secured to a bottom surface of each flap for elevating the flap and allowing entry of the hand beneath the flap to lift the flap.

4. A folder assembly according to claim 1 further characterized in that a strip of the elastic sheet at a margin of the panel along the straight edge of the panel adjacent to the flap is free of the panel to allow for stretching of the sheet and the remainder of the resilient sheet is secured to the flap and panel wherein the free margin of the elastic sheet acts as a combined hinge and spring.

5. A folder assembly according to claim 1 further comprising an adjustable locator means including side edge contacts and an interconnecting elastic member stretched across the flap parallel to the hinged edge, for positioning an end of the work-piece on the folder assembly.

6. A folder assembly according to claim 5 further characterized in that the locator means includes a series of spaced-apart notches on the flap in opposing edges perpendicular to the hinged edge of the flap, said side edge contacts comprising hook members shaped to fit the notches and having an elastic band stretched between the hook members.

7. A folder assembly according to claim 1 further comprising a narrow strip secured to the hinged edge on a front surface of each flap to form an elevated-creasing edge on the flap for engaging a folded over work-piece exteriorly of the fold with a pressing and sweeping motion as the flap is pivoted toward the panel to crease the work-piece.

8. A folder assembly according to claim 1 further comprising a combined retaining and guiding means secured to a top surface of the panel on a side edge immediately abutting each pair of matching, straight edges proximate to each end of each straight edge, wherein the combined retaining and guiding means comprises a strip of thin material, undercut to receive a work-piece, secured to the panel and extending to overlie an edge of the work-piece to guide the work-piece into alignment and retain the work-piece against the edge for folding.

9. A folder assembly for an elongated work-piece comprising:

a relatively flat and rigid panel provided with at least one straight edge and at least one retractable flap provided with a matching straight edge located along the straight edge of the panel and elastic means hingedly connecting the flap to the panel across the matching straight edges, including a resilient sheet material secured to a back surface of the flap and panel wherein the work-piece is folded along the matching straight edges;

an adjustable resilient locator means including side edge contacts and an interconnecting elastic member stretched across the flap parallel to the hinged edge for positioning an end of the work-piece on the folder assembly and a series of spaced-apart notches on the flap in opposing edges perpendicular to the hinged edge of the flap, said side edge contacts comprising hook members shaped to fit the notches and having a resilient band stretched between the hook members.

* * * * *